United States Patent [19]

Reiser et al.

[11] Patent Number: 4,596,543

[45] Date of Patent: Jun. 24, 1986

[54] APPARATUS AND METHOD FOR SETTING UP A BASKET-TYPE CARRIER

[75] Inventors: Carl J. Reiser, Ada, Mich.; Charles F. Abernathy, Ooltewah, Tenn.

[73] Assignee: Packaging Corporation of America, Evanston, Ill.

[21] Appl. No.: 642,048

[22] Filed: Aug. 17, 1984

[51] Int. Cl.[4] ..... B31B 11/00

[52] U.S. Cl. ..... 493/91; 493/124; 493/131; 493/141; 493/313; 493/317

[58] Field of Search ..... 493/88, 90, 91, 122, 493/123, 124, 128, 130, 131, 132, 138, 141, 143, 165, 176, 179, 309, 312, 390, 391, 419, 909, 912, 313, 315–317

[56] References Cited

U.S. PATENT DOCUMENTS

| | | | |
|---|---|---|---|
| 2,479,994 | 8/1949 | Annen | 493/125 |
| 2,811,087 | 10/1957 | Nigrelli | 493/91 |
| 3,512,459 | 7/1967 | Frank | 493/124 |
| 4,154,148 | 5/1979 | Weremiczyk et al. | 493/912 |
| 4,348,853 | 9/1982 | Morse et al. | 493/122 |
| 4,396,116 | 8/1983 | Stone | 206/162 |

*Primary Examiner*—Francis S. Husar
*Assistant Examiner*—Robert Showalter
*Attorney, Agent, or Firm*—Neuman, Williams, Anderson & Olson

[57] ABSTRACT

Apparatus and method are provided for setting up a basket-type carrier from a collapsed state. The carrier includes pair of foldable end panels connected to opposite ends of a slotted base panel, side panels foldably connected to opposite sides of base panel, and pair of foldably connected panel sections forming a handle. Each end panel has foldably connected upper and lower sections initially in face-to-face relation. Each upper section has side segments foldably connected to ends of the panel sections. A U-shaped insert piece is assembled with the carrier and has upstanding legs extending through the slotted base panel and retaining the handle panel sections in face-to-face relation. The panel sections of the collapsed carrier are in coplanar relation and when the collapsed carrier is at a first station, external force is applied to the panel sections causing same to fold relative to one another into upright face-to-face relation. As the panel sections move to face-to-face relation, the upper and lower sections of each end panel partially unfold. The carrier is moved to a second station wherein the upper and lower sections of each end panel assume an upright coplanar relation. The carrier is moved to a third section wherein adhesive is applied to areas of the side panels. The carrier is moved to a fourth station during which the side panels are folded to upright positions and secured to the end panels. The insert piece is assembled on the carrier slotted base panel at a fifth station.

15 Claims, 20 Drawing Figures

FIG. 4
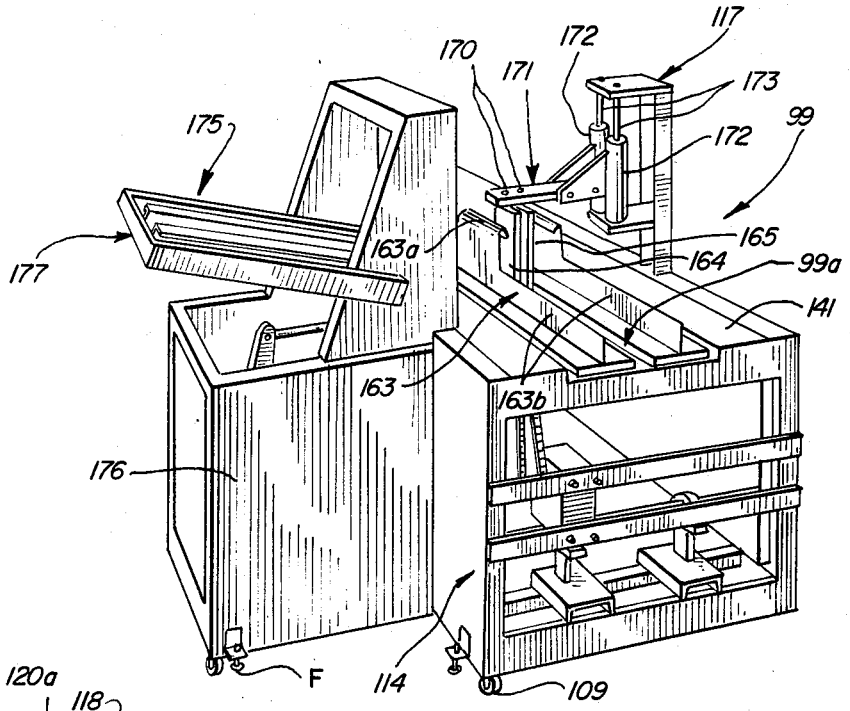
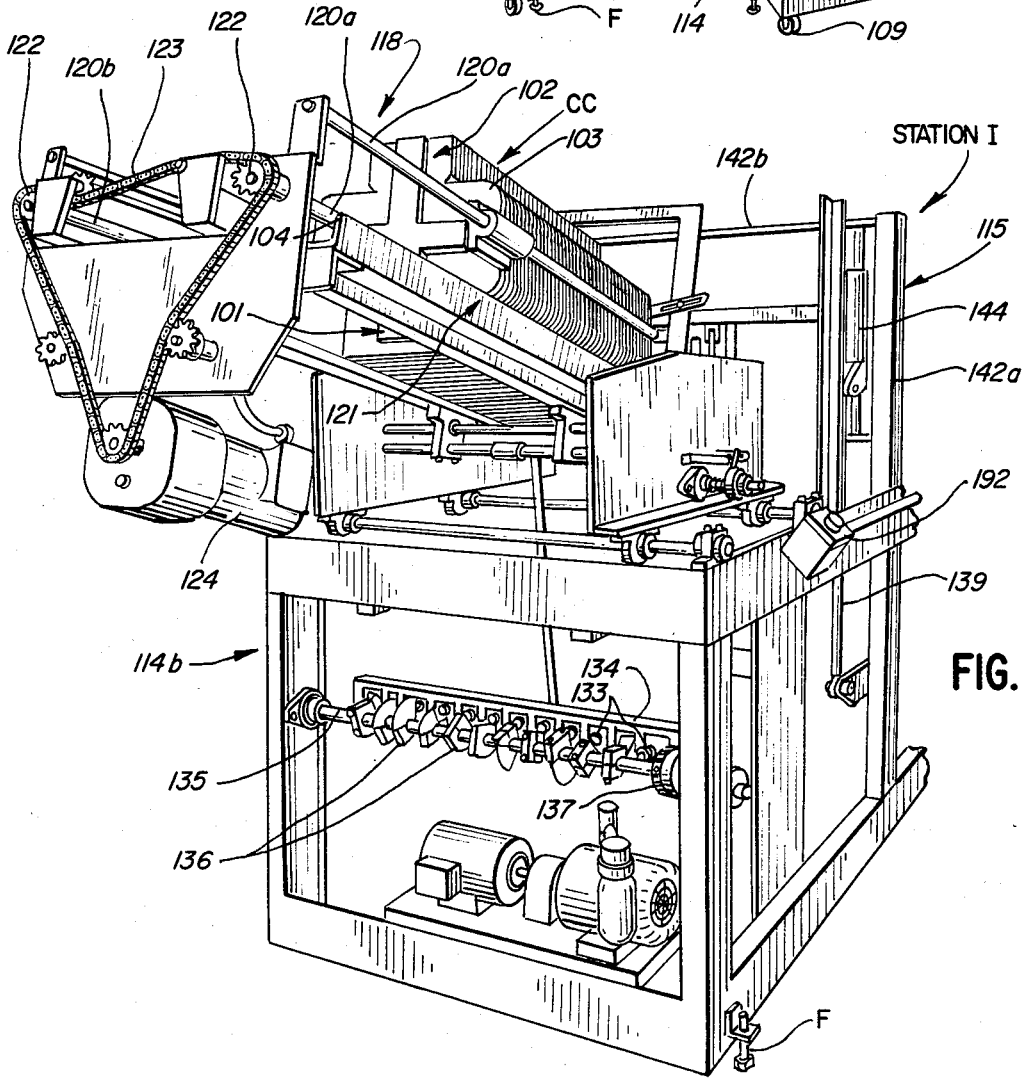
FIG. 5

FIG. 6
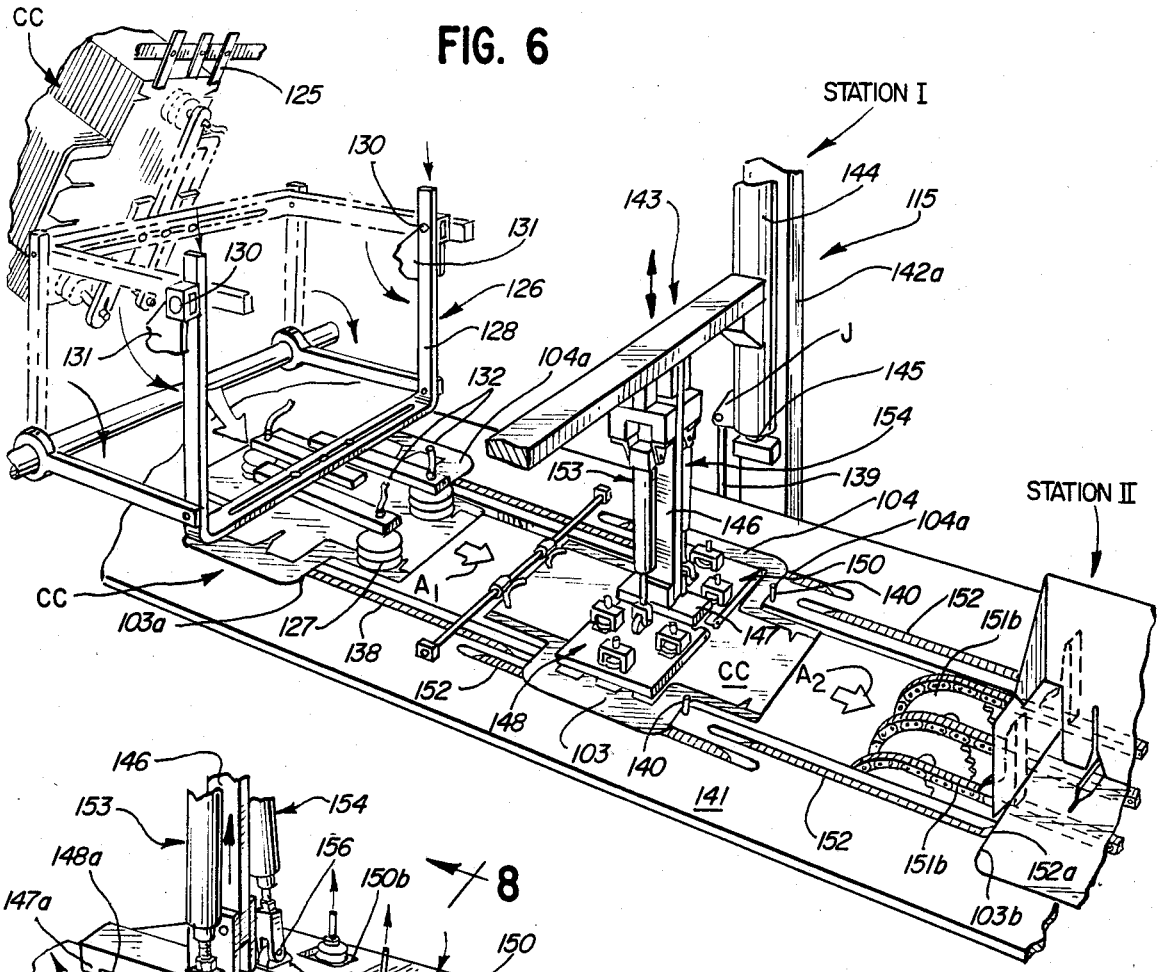
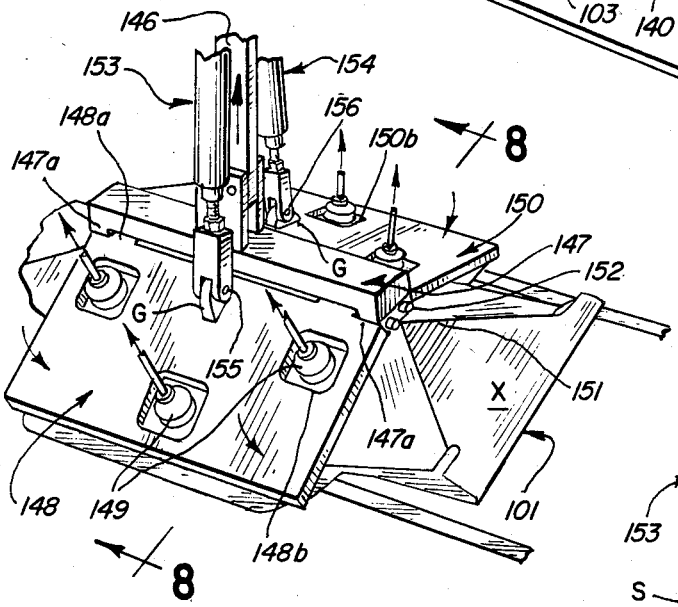
FIG. 7
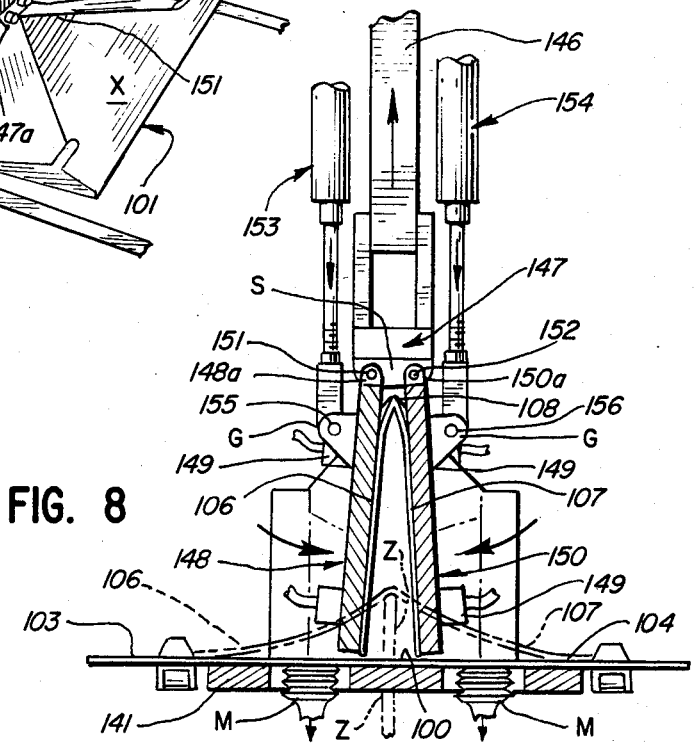
FIG. 8

FIG. 9
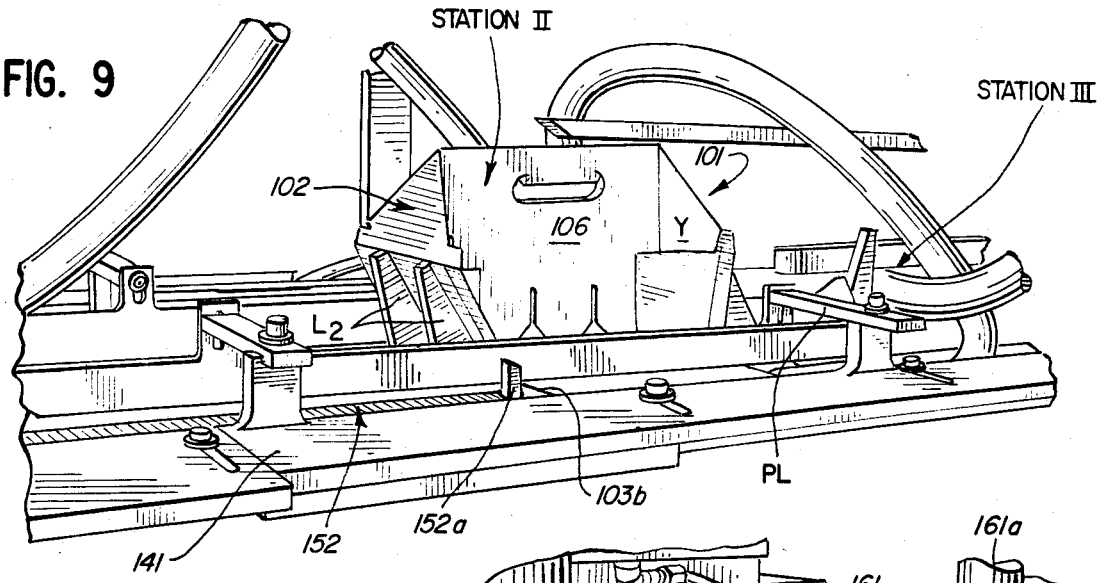
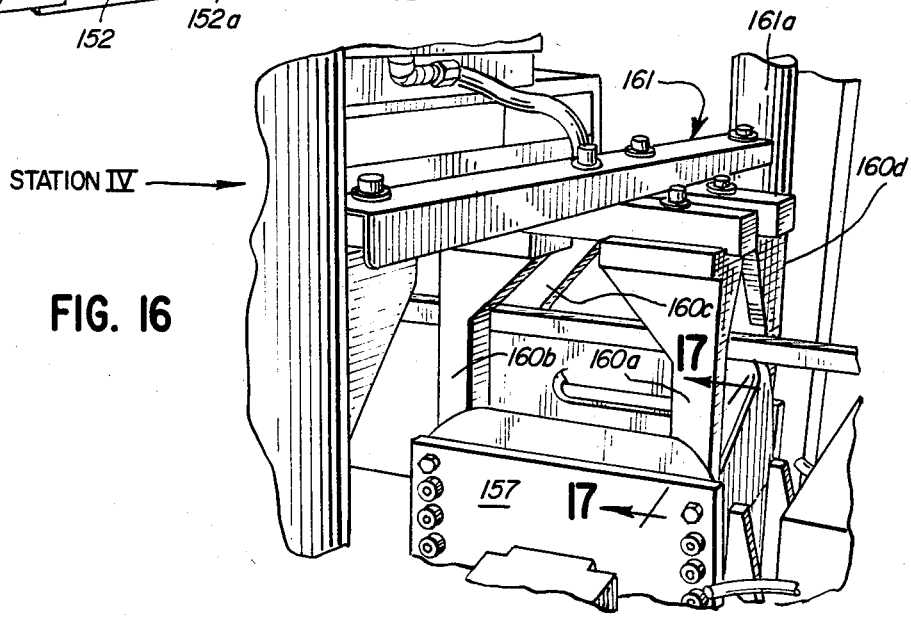
FIG. 16
FIG. 19
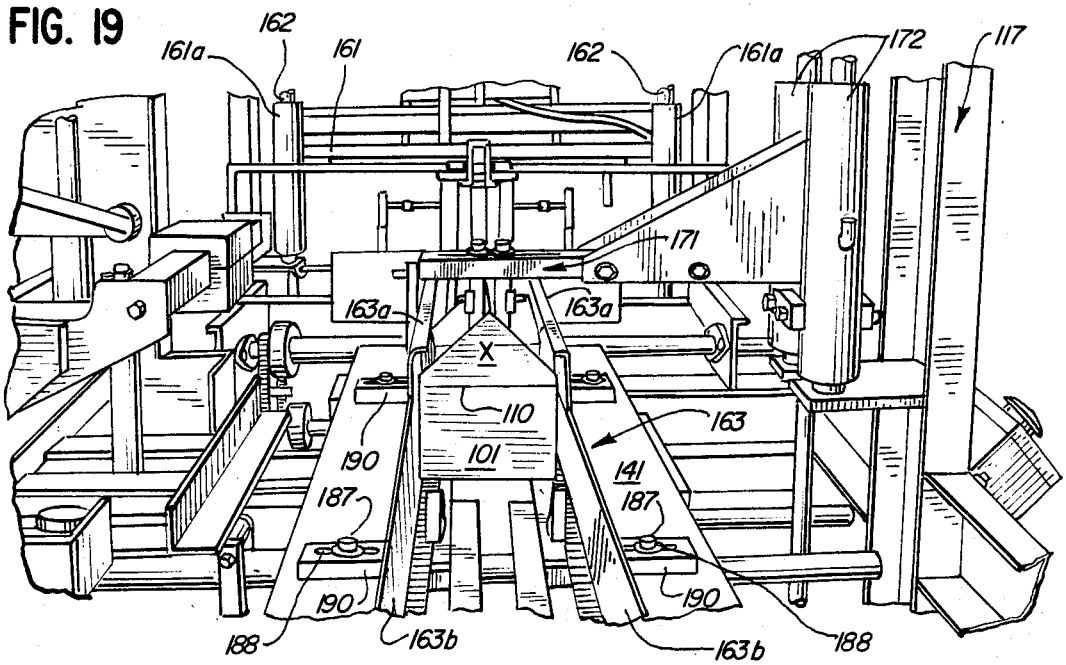

FIG. 10
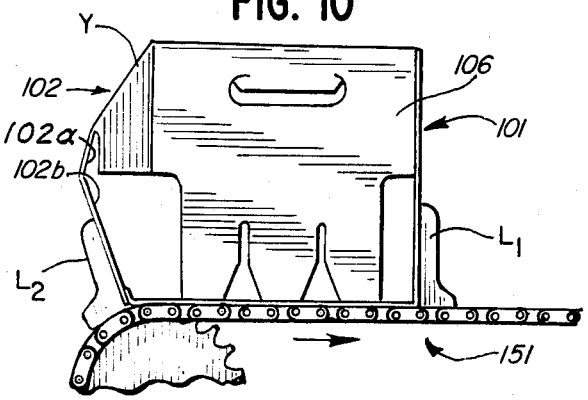
FIG. 11
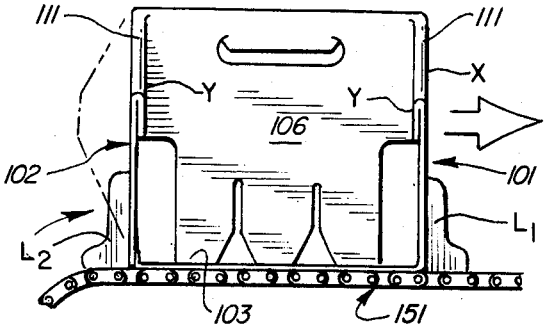
FIG. 12
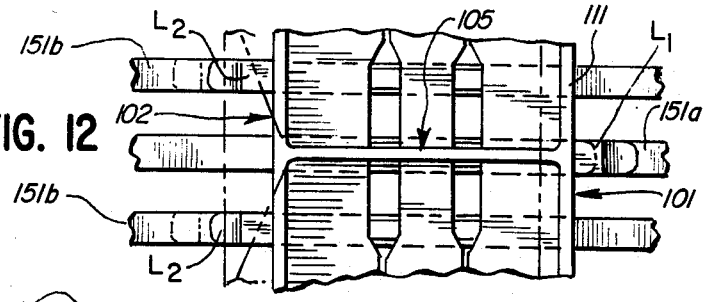
FIG. 13
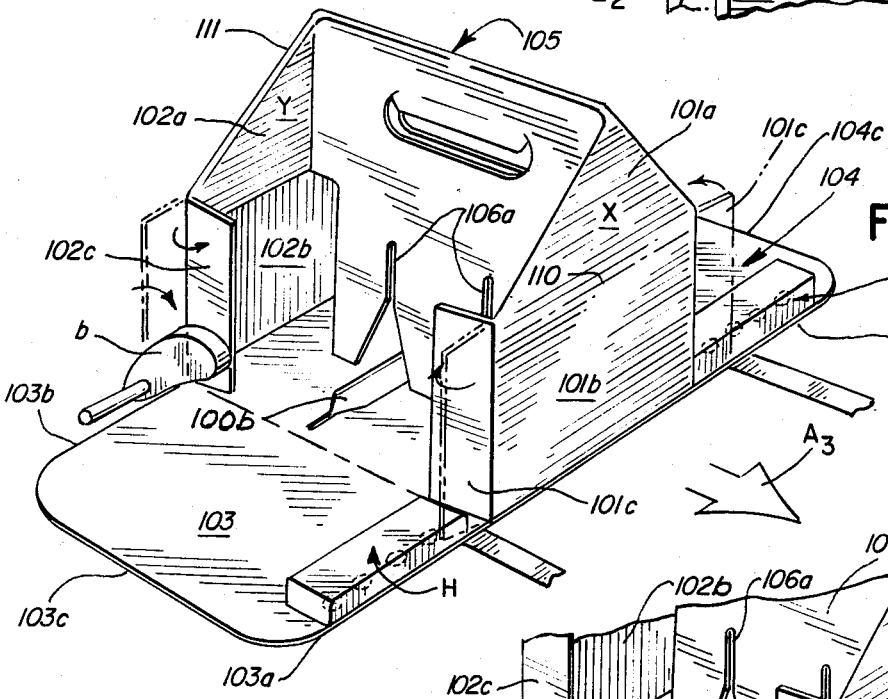
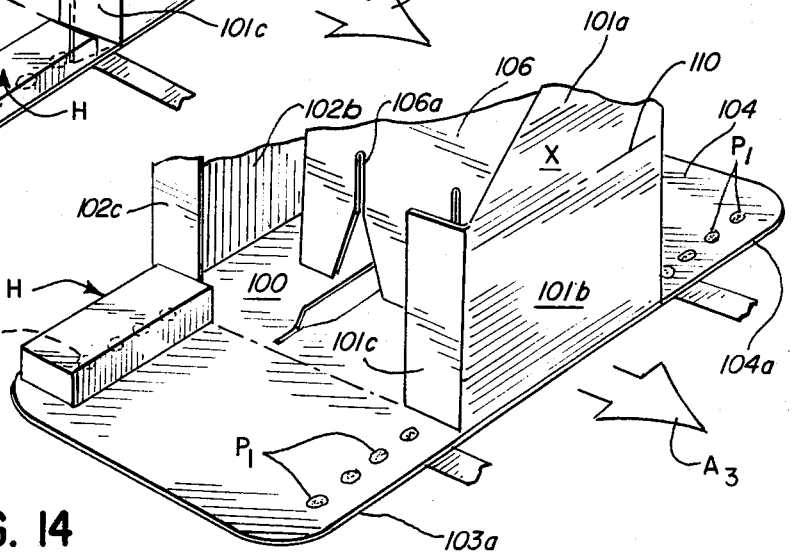
FIG. 14

FIG. 15
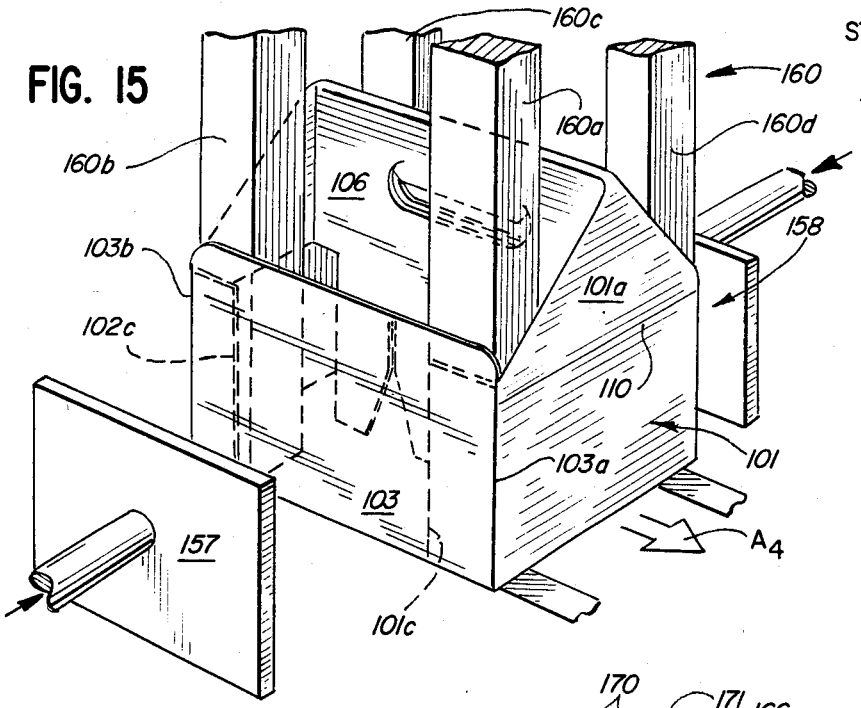
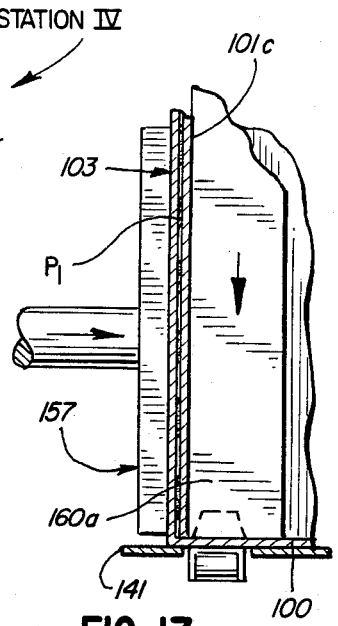
FIG. 17
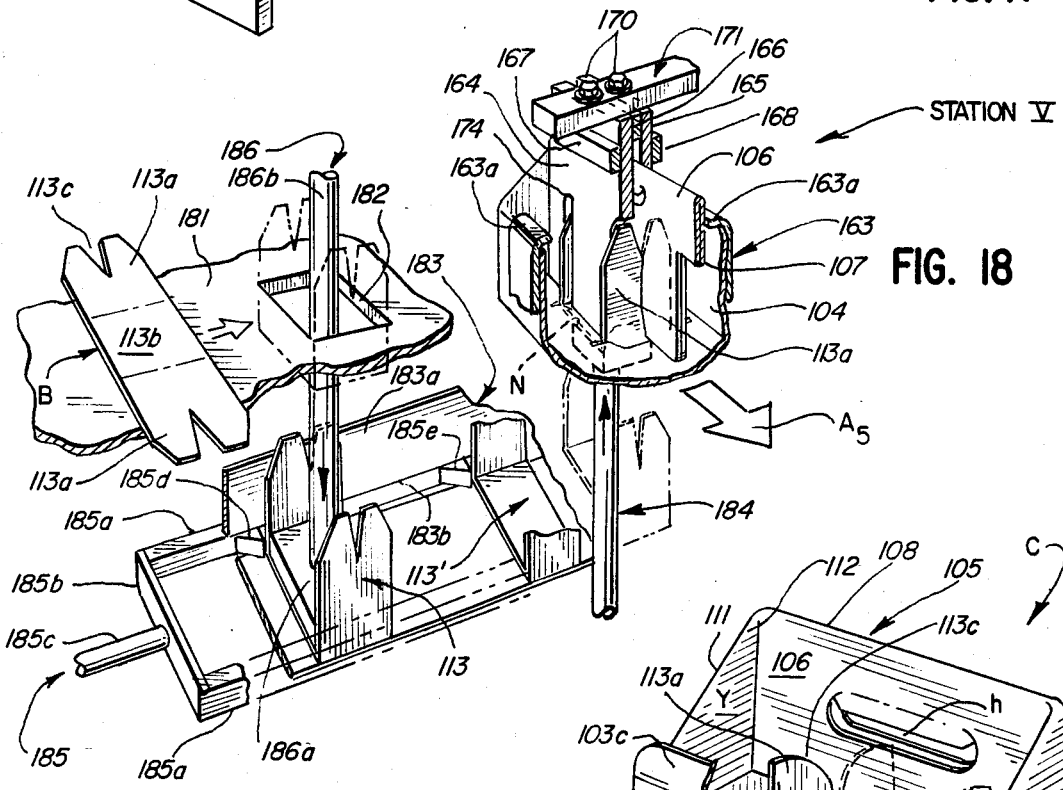
FIG. 18
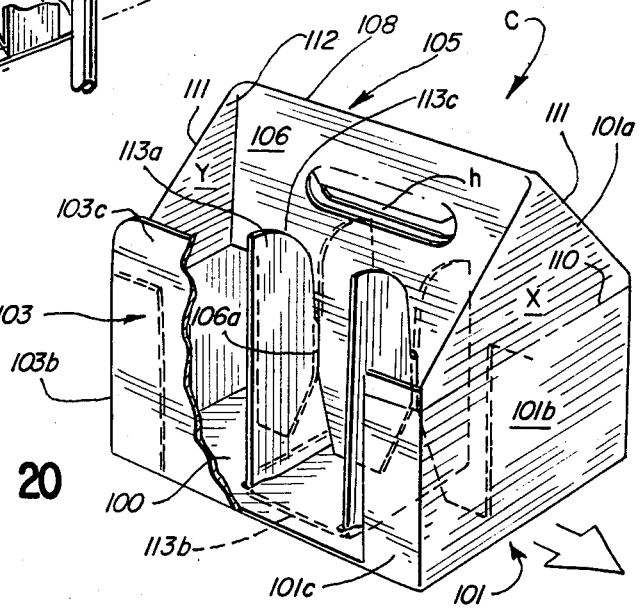
FIG. 20

APPARATUS AND METHOD FOR SETTING UP A BASKET-TYPE CARRIER

BACKGROUND OF THE INVENTION

Various apparatus and methods have heretofore been utilized for setting up, or partially setting up, basket-type carriers and the like; however, because of certain inherent design characteristics of the apparatus they possess a very limited and narrow capacity.

SUMMARY OF THE INVENTION

Thus, it is an object of the invention to provide an apparatus and method which avoid the aforesaid shortcomings.

Further and additional objects will appear from the description, accompanying drawings, and appended claims.

In accordance with one embodiment of the invention, an apparatus and method are provided for setting up a collapsed article carrier. The carrier, when in a collapsed state, includes certain components disposed in a first plane and other components disposed in a second plane. The first and second planes are arranged in proximate substantially parallel relation. The components of the first plane include a slotted base panel, side panels foldably connected to first opposed peripheral segments of the base panel, and lower sections of end panels foldably connected to second opposed peripheral segments of the base panel. The components of the second plane include a pair of coplanar handle unit panel sections having upper edge-forming peripheral segments thereof interconnected by a common foldline, and upper sections of the end panels foldably connected to corresponding side edge-forming peripheral segments of the panel sections. The upper and lower sections of each end panel are foldably interconnected and disposed in folded face-to-face relation in the collapsed carrier. The apparatus comprises a first station wherein a collapsed carrier is retained and horizontally supported with the second plane thereof being exposed. Disposed in vertical alignment with the collapsed carrier is a pair of actuatable hinged elements which are mounted for controlled movement from an inoperative mode, wherein the elements are in coplanar relation and disposed above the stationed collapsed carrier, to an operative mode wherein the elements are in spaced substantially parallel relation causing the handle unit panel sections to assume upright substantially face-to-face relation. As the panel sections move to the upright, substantially face-to-face relation, the upper and lower sections of the end panels partially unfold automatically as the base panel and the side panels remain in a substantially horizontal plane. Upon leaving the first station, the carrier enters a second station wherein the end panels are moved to upright, spaced, substantially parallel relation by coacting projections carried by conveyor means. Upon leaving the second station and entering a third station, side glue flaps, foldably connected to the upright end panels, are folded relative to their respective end panels and adhesive is applied to predetermined surface portions of the horizontally disposed side panels. As the carrier moves from the third station, the side panels are moved to upright positions while the base panel remains in a horizontal plane. At the fourth station the upright side panels are pressed into sealing engagement with the corresponding folded side glue flaps. After a predetermined time interval, the carrier is moved to a fifth station wherein upstanding leg sections of a preformed U-shaped insert piece are inserted upwardly through slots formed in the carrier base panel and interlockingly engage the lower edges of the depending panel sections of the handle unit.

DESCRIPTION

For a more complete understanding of the invention, reference is made to the drawings wherein:

FIG. 4 is a fragmentary perspective view of the discharge end of the apparatus of FIG. 3.

FIG. 5 is a fragmentary perspective view of the infeed end of the apparatus of FIG. 3.

FIG. 6 is a fragmentary perspective top view of the apparatus of FIG. 3 but showing primarily Station I thereof.

FIG. 7 is an enlarged fragmentary top perspective view of certain structural components of FIG. 6 and showing the latter engaging and partially setting up the handle unit panel sections of a collapsed carrier when the latter is disposed at Station I.

FIG. 8 is an enlarged fragmentary sectional view taken along line 8—8 of FIG. 7, but showing in full lines the structural components thereof in an operative mode and the handle unit panel sections in substantially upright face-to-face relation; the panel sections, while in a substantially unfolded state and while being initially engaged by a projecting pin for controlled folding thereof are shown in phantom lines.

Figure 3:
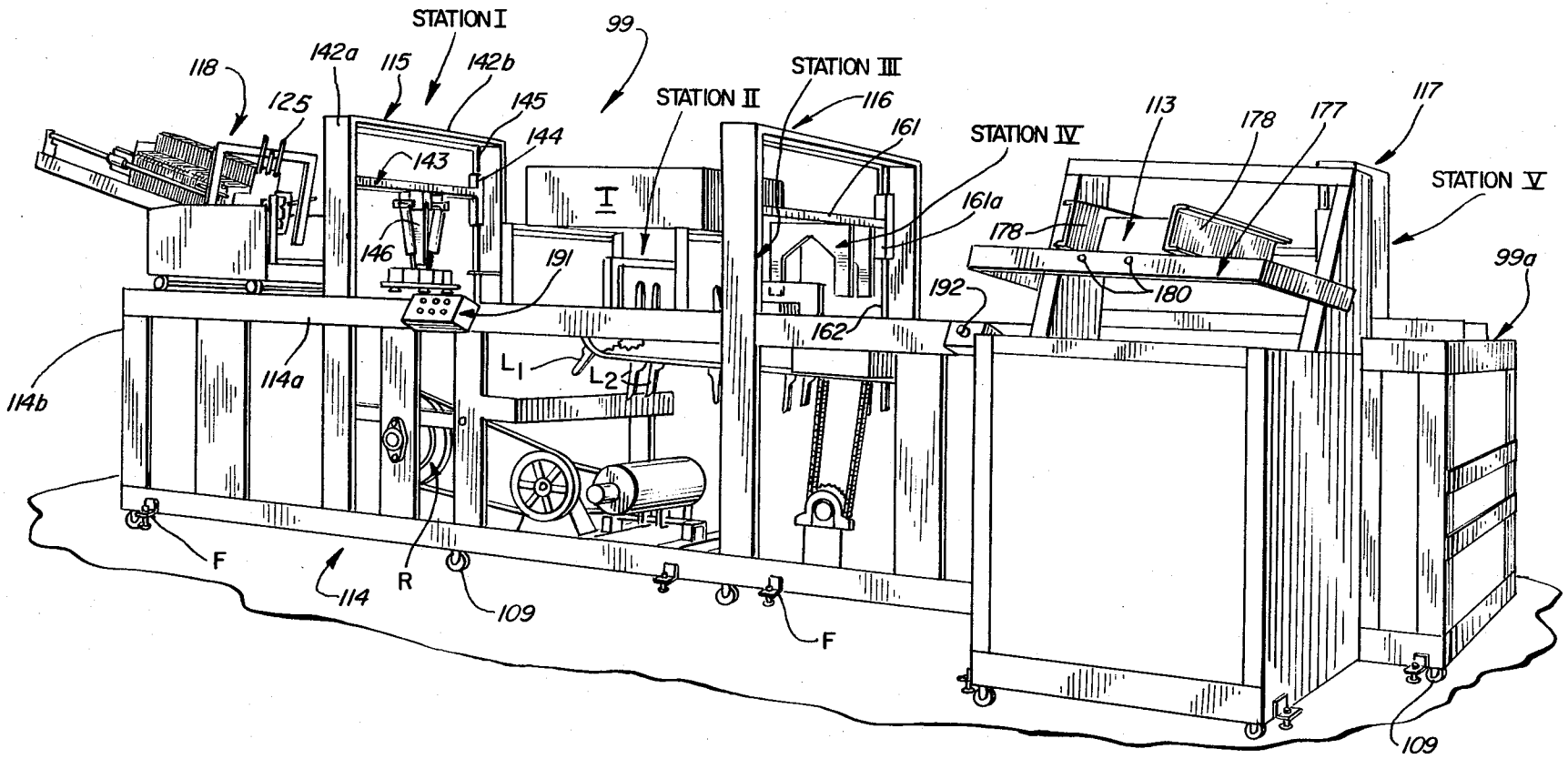
FIG. 3 is a fragmentary side perspective view of one embodiment of the improved apparatus.

FIG. 9 is an enlarged fragmentary side perspective view of the apparatus of FIG. 3 but showing primarily Station II thereof.

FIGS. 10 and 11 are enlarged fragmentary side elevational views of certain structural components of Station II and showing the end panels of a partially set up carrier being successively actuated into upright, substantially parallel positions as the carrier moves through Station II.

FIG. 12 is a fragmentary top view of the structural components and carrier shown in FIG. 11.

FIG. 13 is an enlarged fragmentary side perspective view of a partially set up carrier as the latter is entering Station III of the apparatus of FIG. 3 whereby the leading edge portions of the unfolded side panels of the carrier are aligned beneath adhesive applicators and the trailing side glue flaps of the carrier are folded by pivoting elements (only one being shown) while the forward movement of the carrier is temporarily interrupted at Station III.

FIG. 14 is similar to FIG. 13 but showing the trailing edge portions of the unfolded side panels of the carrier aligned beneath the adhesive applicators.

FIG. 15 is an enlarged fragmentary side perspective view of the carrier when disposed at Station IV and prior to the upright side panels of the carrier being pressed into adhesive engagement with corresponding prefolded side glue flaps; certain structural components of Station IV are also shown.

FIG. 16 is a fragmentary side perspective view of certain structural components of Station IV coacting with one another to press the carrier side panels into adhesive engagement with corresponding side glue flaps.

FIG. 17 is an enlarged fragmentary sectional view taken along line 17—17 of FIG. 16.

FIG. 18 is a fragmentary top perspective view of various structural components comprising Station V including an insert piece supply and forming assembly; a plurality of insert pieces are shown in various locations within the assembly.

FIG. 19 is a fragmentary perspective view taken of the discharge end of the apparatus of FIG. 3 and showing a carrier located at Station V.

FIG. 20 is an enlarged side perspective view of one embodiment of an improved basket-type carrier which has been fully set up by the apparatus of FIG. 3; a portion of one of the upright side panels of the carrier has been removed to reveal the article-accommodating cells formed within the carrier interior.

Figure 1:
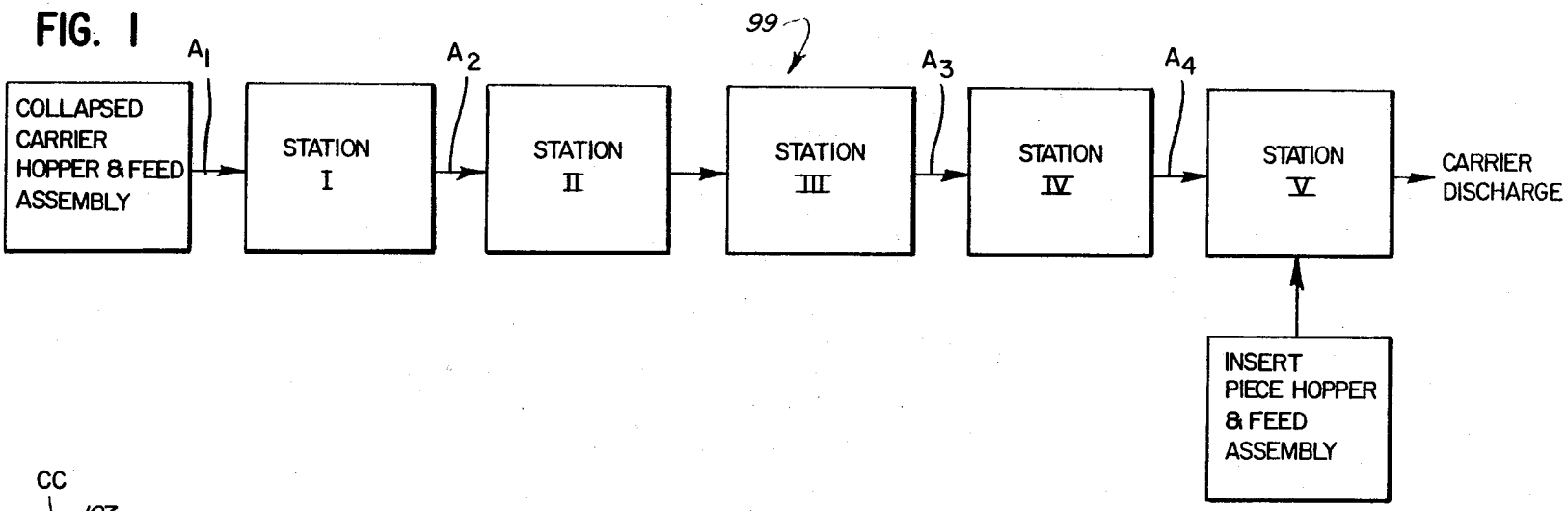
FIG. 1 is a block diagram of one embodiment of the improved apparatus showing the successive stations provided therein for setting up an improved basket-type carrier.
Figure 2:
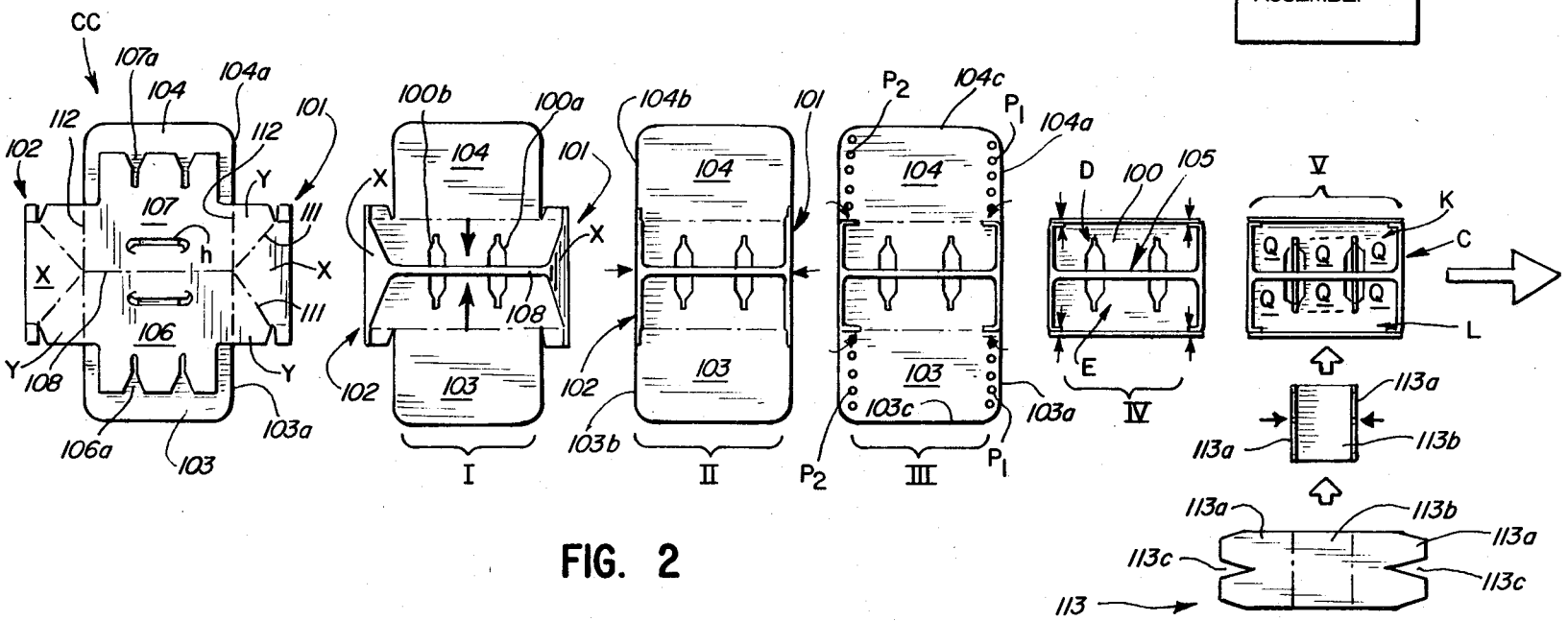
FIG. 2 is a series of top plan views showing successive stages of setting up a collapsed carrier into a fully set up carrier while progressively moving through the various stations of the apparatus shown in FIG. 1.

Referring now to the drawings and more particularly to FIGS. 1 and 2, the various folding manipulations performed and the physical changes in the configuration of an initially collapsed carrier CC are shown which occur as the latter moves through successive stations I–V of the apparatus 99. To facilitate understanding of the structural features of apparatus, the transformation of the collapsed carrier CC to the fully set up carrier C, as seen in FIG. 20, will be described. Carrier C is the subject matter of a pending application, Ser. No. 570,170, filed in the U.S. Patent and Trademark Office on Jan. 24, 1984, and per se forms no part of the claimed invention.

The fully set up carrier C, as shown in FIG. 20, includes a slotted base panel 100, preferably of a rectangular shape; a pair of end panels 101, 102 of like configuration foldably connected to the opposite narrow end edges of panel 100; and a pair of side panels 103, 104 foldably connected to the opposite elongated side edges of panel 100. The upper portions of the end panels are interconnected by a handle unit 105 which includes a pair of panel sections 106 and 107, spanning the distance between the end panels. The corresponding upper edge of the panel sections 106, 107 are interconnected by a common foldline 108.

Each end panel 101, 102 includes an upper section 101*a*, 102*a*, and a lower section 101*b*, 102*b*; corresponding upper and lower sections being interconnected by a common foldline 110. When the carrier is in a collapsed state, the upper sections overlie the lower sections in face-to-face relation, see left hand view, FIG. 2. Foldline 110 is parallel to the foldline connection between the end panel and the base panel 100. The upper section 101*a*, 102*a* of each end panel is formed into a substantially triangular center segment X and a pair of substantially triangular side segments Y which are connected by converging foldlines 111 to corresponding sides of the center segment. The end edges of the handle unit panel sections 106, 107 are connected by foldlines 112 to corresponding side segments Y of the end panel upper sections 101*a*, 102*a*. Each triangular center segment X has an apex thereof aligned with an end of foldline 108. When the carrier C is fully set up, the upper section center segment X and the lower section 101*b*, 102*b* are disposed in coplanar upright relation and the triangular side segments Y are folded downwardly and inwardly so as to be in face-to-face relation with interior surface portions of the corresponding center segment X, see FIG. 20.

Each end panel 101, 102 is provided with side glue flaps 101*c* 102*c* which are folded relative to the upper and lower sections 101*a–b* and 102*a–b* and are adhesively secured to marginal portions of the corresponding upright side panels 103, 104. The base panel 100 is provided with a pair of spaced slots 100*a*, 100*b* which extend transversely of the base panel (i.e., substantially perpendicular to the elongated side edges of the base panel), see FIG. 2. The base panel slots are adapted to accommodate corresponding upright leg sections 113*a* of a separate U-shaped insert piece 113, see FIG. 20. The leg sections have the lower edges thereof foldably interconnected by a bail section 113*b*, which subtends and engages a portion of the exterior surface of the base panel, when the insert piece is assembled on the base panel. The upper distal ends of the leg sections are provided with depending slots 113*c*, open at the upper end. The slots 113*c* interlock with complemental slots 106*a*, 107*a* formed in the lower edges of the handle unit panel sections 106, 107. As seen in FIG. 20, the panel sections 106, 107 are disposed in depending substantially face-to-face relation and divide the carrier interior into a pair of contiguous elongated compartments D, E, see FIG. 2. The upstanding leg sections 113*a* of the U-shaped insert piece 113 serve a dual function: (a) they maintain the panel sections 106, 107 in face-to-face relation, and (b) they divide each elongated compartment D, E into three article-accommodating cells Q. The cell-forming segments of the upstanding leg sections 113*a* prevent contact between articles accommodated in adjacent cells of the compartment D, E, when the loaded carrier is subjected to normal handling or when the carrier is being loaded or unloaded. A suitable handhole h is provided in each panel section 106, 107.

Apparatus 99, as shown in FIGS. 3 and 4, includes an elongated frame 114 which may be formed of a plurality of sections bolted or otherwise fastened together in endwise relation. The frame is preferably provided with a plurality of a casters 109 or the like, which permit the apparatus to be moved to various locations, if desired, so as to be in close proximity to a bottle filling line or the like, also not shown. In addition, vertically adjustable feet F are provided on the underside of the frame 114 to facilitate leveling of a frame when the apparatus is disposed at the desired location. The frame 114, as shown, includes pairs of upright supports 115 and 116 and a single support 117, the functions of the supports will be described more fully hereinafter. Supports 115 are disposed at Station I; supports 116 are disposed at Station IV; and support 117 is disposed at Station V.

Frame 114 is provided with an upper horizontal section 114*a* which serves as a support for drive shafts or the like utilized in various conveyors embodied in the improved apparatus and to be hereinafter discussed. In addition, frame section 114*a* supports various braces; carrier supporting surfaces; and guides between which each carrier passes as it travels through the apparatus.

Mounted on the infeed end 114*b* of frame 114 is a hopper and feed assembly 118 which is adapted to accommodate a plurality of collapsed carriers CC arranged in aligned, substantially upright, face-to-face relation. As seen in FIG. 5, assembly 118 includes a pair of spaced, parallel rotating support shafts 120*a*, 120*b* which are mounted on an assembly frame 121 so as to extend downwardly at an angle of approximately 20° to the horizontal. The upper ends of shafts 120*a*, 120*b* have keyed thereto sprockets 122 which are in driven engagement with a continuous chain 123. The chain is driven by an electric drive motor 124 supported on the underside of frame 121.

The spacing between shafts 120*a*, 120*b* is such that one of the end panels 101 of each collapsed carrier will readily slide therebetween and the leading edges 103*a*, 104*a* of the side panels 103, 104 of said collapsed carrier will be subtended and slidably engaged by the shafts 120*a*, 120*b*. Because of the inclination of the shafts and the simultaneous rotation thereof and a weighted follower engaging the upper endmost carrier in the hopper, the hopper-accommodated collapsed carriers are caused to constantly move towards the lower end of the assembly frame 121. A plurality of yieldable fingers 125, see FIGS. 3 and 6, are mounted on the lower end of frame 121 and prevent the endmost collapsed carrier from being prematurely discharged from the frame lower end until it is engaged by a feed mechanism 126. The illustrated mechanism includes a plurality of vacuum cups 127 which are mounted on a U-shaped member 128, the latter in turn being mounted to pivot about axially aligned pins 130 supported by stationary upright extensions 131 of the assembly frame. When member 128 is disposed in a substantially horizontal position, shown in phantom lines in FIG. 6, the vacuum cups 127 will engage exposed surface portions of the endmost collapsed carrier positioned at the lower end of frame 121. Upon a vacuum being drawn on cups 127, the exposed surface portions of the adjacent endmost collapsed carrier will become attached to the cups whereupon as the member 128 is pivoted to a down position, shown in full lines in FIG. 6, the attached collapsed carrier will be pulled away from behind the fingers 125 and placed in a horizontal plane. Each vacuum cup 127 is connected by suitable flexible tubing 132 to a vacuum pump, not shown. The operation of the vacuum pump is controlled by suitable mechanism, not shown, mounted at a remote location on the frame 114. As seen in FIG. 5, a series of switches 133 are mounted in spaced side by side relation on a horizontally disposed bracket 134 which is located at the infeed end 114*b* of the frame 114. The operating sequence of the switches 133 is determined by a timing shaft 135 disposed in spaced parallel relation with bracket 134. Shaft 135 has fixedly mounted thereon a plurality of axially spaced individual cams 136. The number of cams corresponds to the number of switches 133 mounted on bracket 134. Shaft 135 is rotated by a timing chain 137.

When the collapsed carrier CC has been deposited in a horizontal plane by the feed mechanism 126, the deposited collapsed carrier CC, as seen in FIG. 6, is then moved horizontally in the direction of arrow $A_1$ by lugs provided on a conveyor 138 until the leading side edges 103*a*, 104*a* of the side panels 103, 104 of the collapsed carrier engage a pair of upwardly extending stop pins 140. The pins 140 are mounted for vertical adjustment between extended and retracted positions. When the pins 140 are in retracted positions, the collapsed carrier is free to move therepast, as will be described more fully hereinafter. When the collapsed carrier is in contact with the extended stop pins 140, the carrier is properly disposed at Station I.

Besides upright supports 115, Station I includes a horizontal platform surface 141 on which the collapsed carrier rests. Supports 115 comprise a pair of upright column sections 142*a* disposed on opposite sides of surface 141. The upper end portions of the column sections 142*a* are interconnected by a transversely extending cross member 142*b*, see FIG. 3. Disposed between the column sections and beneath the cross member and in parallel relation with respect to the latter is a vertically adjustable horizontal support bar 143. The ends of the bar 143 have attached thereto cylindrical sleeves 144 which are adapted to slidably accommodate upright shafts 145. Each shaft is fixedly mounted adjacent to and inwardly of a corresponding column section 142*a*. Vertical adjustment of bar 143 is effected by a pair of-upright arms 139 which have the upper ends thereof pivotally connected to lugs J projecting laterally from the lower ends of the sleeves 144. The lower ends of arms 139 are pivotally connected to the ends of rocker arms, not shown, which are disposed beneath the platform surface 141 and pivot about horizontal axes. Movement of the arms is effected by rotating cams R, see FIG. 3.

Depending from bar 143 and disposed substantially equidistant from column sections 142*a* is a vertical support member 146. Fixedly attached to the lower distal end of member 146 is an elongated crosspiece 147, which is disposed substantially parallel to the direction of travel $A_2$ of the collapsed carrier CC as it leaves Station I, see FIG. 6. Hingedly connected to piece 147 are a pair of forming plates 148, 150, see FIGS. 7 and 8. Each plate is of like configuration and has the upper edge thereof provided with a pair of protruding hinge components 148*a*, 150*a* which are complemental with a pair of hinge components 147*a* formed on the underside of crosspiece 147. Each of the complemental hinge components 147*a*, 148*a*, and 150*a* is provided with a bore. The bores of corresponding hinge components are in alignment and accommodate a section of a hinge pin 151 or 152, see FIGS. 7 and 8. As viewed in FIG. 7, one hinge pin section is disposed within the bores formed in the near hinge components provided on the crosspiece and forming plate, and the other hinge pin section is disposed within the bores formed in the far hinge components.

Disposed laterally on opposite sides of the vertical support member 146 are piston-cylinder assemblies 153, 154. Each assembly is adjustably supported on the underside of support bar 143. The piston of each assembly projects from the lower end of the cylinder and is pivotally connected at 155, 156 to a lug G formed on the upper surface of each forming plate 148, 150. The piston of each assembly is preferably pneumatically actuated so as to effect pivoting of the plates 148, 150 about the sectional hinge pins 151, 152 between the horizontal inoperative mode (FIG. 6) and a vertical operative mode (FIG. 8). It will be noted in FIG. 8 that the hinge pins 151, 152 are laterally spaced from one another by an amount slightly greater than the thickness of handle unit, when the panel sections thereof are arranged in substantially face-to-face relation, see FIG. 8. The spacing S between the hinge axes of the plates 148, 150 allows the foldably connected upper edges of the panel sections 106, 107 to be slidably disposed therein when the plates 148, 150 move from the inoperative mode to the operative mode.

Each folding plate 148, 150 is provided with a plurality of openings 148*b*, 150*b* in which are disposed a corresponding number of vacuum cups 149. The cups of each plate are arranged so that when the plates 148, 150, while in a coplanar relation, are lowered relative to the collapsed carrier, positioned at Station I, the cups of each plate will engage corresponding exposed surface portions of the carrier handle unit panel section disposed therebeneath. Prior to the folding plates 148, 150 pivoting about their respective hinge axes 151, 152 to the operative mode, a vacuum is drawn on the plate cups 149 causing the latter to positively engage the carrier panel sections.

In order to effect controlled folding of the carrier panel sections about foldline 108 as the folding plates 148, 150 begin to pivot toward one another into the operative mode, a pair of breaker pins Z, only one being shown in phantom lines in FIG. 8, project upwardly through suitable slots, not shown, formed in platform surface 141 and engage and support the underside, or concealed side, of the foldline 108 and function to maintain the foldline 108 of the carrier in proper relative position with respect to the plates 148, 150 as the latter complete their pivotal movement. The breaker pins move upwardly approximately 2", simultaneously with the plates. As the plates pivot towards one another, the support bar 143, vertical support member 146, and crosspiece 147 simultaneously move upwardly as a unit so as to enable the folding plates 148, 150 and the respective carrier panel sections 106, 107 engaged thereby to pivot together without interference from the horizontal platform surface 141 until the panel sections assume the upright substantially face-to-face relation shown in FIG. 8.

Once the breaker pins Z have been extended to their fullest extent, the folding plates 148, 150 and engaged carrier panel sections will continue their upward movement while the breaker pins return to their retracted positions beneath the platform surface 141.

As the carrier panel sections 106, 107 are moved to their upright face-to-face positions, the upper and lower sections 101*a–b* and 102*a–b* of the end panels will automatically partially unfold because the upper section 101*a*, 102*a* of each end panel is foldably connected to an end edge of a corresponding panel section by a foldline 112.

While the carrier panel sections 106, 107 are moved to their upright face-to-face positions, the base panel 100 of the carrier is engaged by a plurality of vacuum suction cups M, see FIG. 8, which are disposed within suitable openings formed in the platform surface 141. Suction cups M engage the underside of the base panel 100 and positively hold the base panel in a horizontal plane against platform surface 141. Because the side panels 103, 104 of the carrier are initially in coplanar relation with the carrier base panel and are foldably connected only to the base panel, they (side panels 103, 104) will continue to remain in coplanar relation with base panel while the carrier is disposed at Station I. A vacuum is drawn simultaneously on the suction cups M and suction cups 149 carried on the folding plates 148, 150. Once the carrier panel sections are in the upright face-to-face relation, the stop pins 140 are retracted and the vacuum on the suction cups 149 and M is cut off; thus, enabling the partially set up carrier to be moved along platform surface 141 from Station I to Station II in the direction of arrow $A_2$, see FIG. 6. Before this carrier movement occurs, the folding plates 148, 150 once again resume their coplanar, horizontal positions, and the bar 143, vertical member 146, and crosspiece 147 are raised as a unit so as to clear the top of the partially setup carrier. The partially setup carrier is then moved to Station II wherein the leading end panel 101 of the carrier engages an elongated transversely extending lug $L_1$ incorporated in section 151*a* of a conveyor 151, see FIG. 12. Movement of the carrier CC from Station I to Station II is effected by an intermediate conveyor 152, see FIG. 6. The conveyor 152 is provided with lugs 152*a* which simultaneously engage the trailing edges 103*b*, 104*b* of the horizontally disposed side panels 103, 104, see FIGS. 6 and 9. Once the leading end panel 101 of the carrier has engaged the conveyor lug $L_1$, the trailing end panel 102 of the carrier will be engaged by a pair of second lugs $L_2$, which are incorporated in a pair of conveyor sections 151*b*, see FIGS. 10 and 11. The conveyor section 151*a* is disposed between conveyor sections 151*b*, see FIGS. 6 and 12. Lugs $L_2$ make contact with the lower section 102*b* of the carrier end panel 102 as the lugs are about to assume horizontal travel along the platform surface 141, see FIG. 10. Because of the longitudinal spacing between lugs $L_1$ and $L_2$, the latter will cause the end panels 101, 102 to assume their upright fully unfolded parallel relation, see FIG. 11. As the upper and lower sections 101*a–b* and 102*a–b* are fully unfolded by the coaction of lugs $L_1$, $L_2$ the triangular side segments Y of the upper section 101*a*, 102*a* of each end panel will simultaneously fold inwardly about lines 111 into face-to-face relation with the interior surface of the corresponding center segment X of the end panel, see FIG. 11.

While the end panels of the carrier are being fully setup by the coaction of lugs L1, L2, the partially setup carrier is being moved by conveyor sections 151*b* to Station III, see FIGS. 9 and 13. When the leading end panel 101 of the partially setup carrier has reached Station III, the leading edge portions 103*a*, 104*a* of the horizontally disposed side panels 103, 104 will be properly positioned beneath corresponding adhesive applicators or heads H, H', see FIG. 13. To facilitate understanding of the operation of the components comprising Station III the applicators are shown as rectangular blocks which are horizontally disposed relative to one another. The applicators are elevated relative to the platform surface 141 an amount sufficient to allow the carrier side panels 103, 104 to pass therebetween. As the partially setup carrier moves from Station II to Station III, the glue flaps 101*c* foldably connected to the leading end panel 101 are engaged by conventional plows PL (see FIG. 9) which are disposed in the path of movement of end panel 101 and cause the glue flaps to be folded rearwardly at substantially 90° from the plane of the end panel lower section 101*b*. Once the leading edge portions 103*a*, 104*a* of the side panels 103, 104 are properly positioned beneath the applicators H, H', the forward movement of the partially setup carrier is interrupted temporarily while the glue flaps 102*c* of the rear end panel 102 are folded forwardly approximately 90° by a pair of pivotal bladelike members b. The members pivot about a horizontal axis which is disposed below the platform surface 141. Suitable slots or openings, not shown, are provided in surface 141 through which the members b pass while moving between operative (extended) positions, as shown in FIG. 13 and inoperative (retracted) positions, not shown. When forward motion $A_3$ of the carrier again resumes a pattern of adhesive $P_1$ is instantaneously applied to the leading edge portions 103*a*, 104*a* of the side panels by the applicators H, H'. By withholding application of the adhesive until the carrier is moving forward again, the premature drying of the applied adhesive is avoided. The adhesive is supplied to the applicators from a reservoir or tank T which is mounted in an elevated position above the platform surface 141, see FIG. 3. Suitable tubing, not shown, connects the tank to the applicators. A suitable pump and timing valve, not shown, are associated with the tank for controlling the adhesive discharged from the applicators.

There is no interruption in the forward movement of the carrier when the trailing edge portions 103*b*, 104*b* of the side panels are disposed beneath the applicators H, H'; thus, a second pattern of adhesive P2 is applied in a substantially instantaneous manner to the moving edge portions 103*b*, 104*b* as the latter pass beneath the applicators. The locations of the adhesive patterns P1 and P2 on the side panels are such that they are aligned with the corresponding glue flaps 101*c*, 102*c* which are foldably connected to the upright side edges of the leading and trailing end panels 101, 102, respectively.

As the partially setup carrier is moved from Station III to Station IV, by the conveyor sections 151*b*, the side panels 103, 104 are automatically folded to upright positions relative to the base panel 100 by plows, not shown, mounted adjacent the platform surface 141. The upright side panels are disposed in substantially parallel relation with respect to one another. When the carrier has reached Station IV, see FIG. 15, its forward motion is again interrupted. The spacing between successive coacting lugs L1 and L2 on conveyor sections 151*a* and 151*b* is such that a partially setup carrier may be disposed at Station III (see FIG. 13) while the preceding partially setup carrier is simultaneously disposed at Station IV, see FIGS. 15, 16.

Station IV includes a pair of laterally disposed transversely aligned presser plates 157, 158 which are mounted for simultaneous horizontal movement towards or away from corresponding upright side panels 103, 104 of the carrier; and a vertically adjustable backup member 160, the latter having a plurality of depending fingers 160*a*, 160*b*, 160*c* and 160*d*. One finger is adapted to be aligned and in engagement with the interior surface of a given glue flap 101*c*, 102*c* of the carrier. The upper ends of the fingers are interconnected and are secured to a horizontally disposed, transversely extending support bar 161, see FIGS. 3 and 16. The ends of the bar terminate in sleeves 161*a* which are adapted to be in slidable contact with upright posts 162, see FIGS. 3 and 19. The vertical movement of the bar 161 and associated sleeves 161*a* may be effected by a mechanism, not shown, which is similar to that previously described with regard to the support bar 143 and associated sleeves 144 disposed at Station I.

When the pressure plates 157, 158 are disposed in an inoperative mode, as shown in FIG. 15, they are spaced apart from one another a sufficient amount so that the partially setup carrier with its side panels in upright positions may readily pass therebetween. To allow the partially setup carrier to move between the spread apart presser plates, the depending backup fingers 160*a–d* and associated parts are in a raised position, not shown. Once the partially setup carrier has come to rest at Station IV, the fingers are lowered into the interior of the carrier until the lower distal ends of the fingers are in contact with or in close proximity to the base panel 100, see FIG. 17. In addition, each depending finger has a vertical flat surface which is in supporting engagement with the interior surface of the given glue flap 101*c*, 102*c* of the carrier. When the fingers are in supporting engagement with the carrier glue flaps, the presser plates 157, 158 are simultaneously actuated toward one another until they exert a predetermined pressing force on the exterior surfaces of the upright side panels and cause the glue flaps and the portions of the side panels to which the adhesive patterns P1, P2 have been applied, to be fixedly secured to one another. Each presser plate has a planar vertical surface which is adapted to engage a substantial portion of the corresponding side panel exterior surface.

Once the necessary force has been exerted on the side panels so as to effect adhesive securement between the glue flaps and the side panels, the presser plates return to their spread apart inoperative mode and the backup fingers are withdrawn from the carrier interior thereby allowing the carrier to resume its forward motion along the platform surface in direction $A_4$ until it reaches Station V, see FIGS. 3, 4, 18 and 19. While moving along the platform surface 141, the carrier passes between a pair of parallel, upright, elongated guide members 163. A segment of the upper edge 163*a* of each guide member is bent over inwardly so as to form an inverted J-shaped pocket. Each pocket slidably accommodates an upper edge portion 103*c*, 104*c* of the corresponding side panel of the carrier as the latter approaches Station V. Mounted for vertical movement above the guide members 163 is a pair of depending plates 164, 165, see FIG. 18. The plates are of like construction and are disposed in spaced substantially parallel relation. The plates are maintained in proper spaced relation by a spacer piece 166. The upper exterior portions of plates 164, 165 are engaged by hold-bars 167, 168. The hold-bars are maintained in place by transversely extending tie bolts or the like, not shown. The spacing between the plates 164, 165 is sized to accommodate the upper portion of the handle unit 105 formed by the panel sections 106, 107 thereof being arranged in upright face-to-face relation, see FIG. 18. The upper portions of the depending plates 164, 165 are secured by bolts 170 which extend through one or more apertures formed in a transversely extending cantilever-type support assembly 171, see FIGS. 4, 18 and 19. The assembly is provided with a pair of cylindrical sleeves 172 which slidably engage upright, parallel bars 173 fixedly secured to the upright column or support 117 of the frame. Vertical movement of the assembly 171 may be controlled mechanically in a manner similar to that previously described with respect to support member 143.

The lower portion of each plate 164, 165 is provided with a pair of upwardly extending slots 174. Each slot 174 is transversely aligned with corresponding slots 106*a*, 107*a* formed in the panel sections 106, 107 of the carrier handle unit 105. In addition the lower open end of each plate slot 174 is in vertical alignment with a slot 100*a*, 100*b* formed in the base panel 100 of the carrier. The function of the depending plates 164, 165 will become apparent hereinafter.

The platform surface 141 at Station V is provided with an enlarged opening N, see FIG. 18, which simultaneously registers with both slots 100*a*, 100*b* of the carrier base panel 100, and spans the distance therebetween so that the upstanding legs 113*a* of the U-shaped insert piece 113 can readily pass therethrough when the insert piece is being assembled with the carrier, as will be described more fully hereinafter.

As seen more clearly in FIG. 4, there is provided a hopper and feed assembly 175 for flat insert piece blanks B which is disposed adjacent Station V and extends transversely from the platform surface 141. Assembly 175 includes an upright frame 176 which is secured to frame 114 and is disposed in transverse alignment with the upright supports 117, located at Station V. Elevated relative to the plane of platform surface 141 and disposed to one side thereof is an inclined hopper section 177 in which a plurality of blanks B of unfolded insert pieces 113 are arranged in substantially upright face-to-face relation. One elongated edge of each blank engages the inclined surface of the hopper section 177. Adjustable side walls 178, see FIG. 3, are provided to retain the blanks in registered face-to-face relation. The inclined surface of the hopper may be formed by a pair of spaced parallel bars 180 which oscillate about their longitudinal axes and over which slide the blanks and a weighted follower engaging the upper endmost blank. Associated with the lower end of the hopper surface is a feed mechanism, not shown, which causes the lower endmost blank to be individually removed from the remainder of the blanks and placed in a horizontal plane on an elevated surface 181 and in overlying relation with an opening 182 formed therein, see FIG. 18. The configuration of the opening 182 corresponds substantially to the shape of the bail section 113*b* of the insert piece 113.

Disposed beneath surface 181 and in aligned relation with the opening 182 is the open side of an elongated, channel-shaped passage 183. The passage 183 extends beneath the portion of the platform surface 141 on which the carrier is disposed when at Station V. At the inner end of passage 183 there is located a vertically adjustable member 184 having an enlarged horizontally disposed head which subtends and supports the bail section 113*b* of the U-shaped insert piece 113, once the latter has been moved along passage 183 so that it is directly beneath the opening N in the platform surface through which the insert piece must pass when being assembled with the carrier base panel 100. The side walls 183*a* of the channel-shaped passage 183 maintain the leg sections 113*a* of the insert piece 113 in their proper upright parallel relation as the piece moves along the passage.

In the illustrated embodiment, FIG. 18, movement of the insert piece along passage 183 is effected by a reciprocating unit 185. The unit 185 includes a pair of elongated arms 185*a* which are in spaced parallel relation and disposed outwardly of the passage side walls 183*a*. The outer ends of the arms are interconnected by a crosspiece 185*b* which, in turn, is connected to the exposed end of a horizontally extending piston rod 185*c*. Each arm 185*a* is provided with a pair of longitudinally spaced pawls 185*d*, 185*e*. When the arms 185*a* are moving forwardly in a horizontal direction towards the elevating member 184, the corresponding pawls 185*d*, 185*e* on the arms project into the passage 183 through slots 183*b* formed in the side walls 183*a* of the passage. When the arms are moving rearwardly in the opposite direction away from member 184, the pawls assume retracted positions.

When the pawls are in the extended position and the arms begin their forward movement, pawls 185*d* will engage the back edge of the newly formed insert piece 113 which had been previously deposited in the passage 183 by an enlarged head 186*a* which in turn is connected to the lower end of a vertically adjustable plunger 186. The head 186*a* coacts with the opening 182 causing the flat insert piece blank B to assume its U-shaped configuration.

Simultaneously with the pawls 185*d* engaging the newly formed U-shaped insert piece, the projecting pawls 185*e* engage the backside of a preceding U-shaped insert piece 113 which is disposed approximately midway along the passage 183 between plunger 186 and adjustable member 184. Thus, during the forward stroke, or movement, of unit 185, the insert piece 113 is moved by pawls 185*d* to the midway point in the passage 183, and the preceding insert piece 113 is moved by pawls 185*e* to an aligned position beneath the opening N in the platform surface on which the base panel 100 of the carrier is located when the carrier is disposed at Station V. The direction of movement of the arms 185*a* automatically affects the adjustment of the pawls 185*d*, 185*e*.

The sequence of movement of plunger 186, unit 185 and member 184 is controlled by the cams 136 mounted on the timing shaft 135 which engage the switches 133 mounted on the bracket 134, see FIG. 5.

As the leg sections 113*a* of the insert piece pass upwardly through the carrier base panel slots 100*a*, 100*b*, due to the upward movement of elevating member 184, the leg sections will be accommodated in the slots 174 of plates 164, 165 and the slots 113*c* of the leg sections will be aligned with the corresponding open ends of the slots 106*a*, 107*a* formed in the lower edges of the panel sections 106, 107, whereupon the leg sections will interlock with the depending panel sections of the handle unit 105. To prevent simultaneous upward movement of the carrier as the insert piece is being pushed up into assembled relation with the panel sections, the upper edges 103*c*, 104*c* of the carrier side panels, disposed within the inverted J-shaped pockets of guide members 163 are restrained by the inwardly bent over segments of the upper edges 163*a* of the guide members.

After the insert piece 113 has been properly assembled within the carrier, the plates 164, 165 are raised so as to clear the top of the carrier and the member 184 is retracted, or lowered, until it is in coplanar relation with the bottom surface of the channel passage 183. Once the plates 164, 165 clear the top of the carrier, the latter is once again moved along platform surface 141 in the direction of arrow $A_5$, see FIG. 18, to the discharge end 99*a*. of the apparatus 99, shown in FIG. 4. It will be noted that portions 163*b* of guide members 163, which have a reduced height, extend from Station V to the discharge end 99*a* of the apparatus. The guide members 163 may be adjusted towards one another or spread apart so as to accommodate carriers of various widths. The adjustment is accomplished by loosening bolts 187 which secure the guide member to the platform surface 141, see FIG. 19. The shank of each bolt extends through an elongated slot 188 formed in a laterally extending tab-like member 190 secured to the exterior surface of each guide member.

To accommodate carriers of varying lengths, the spacing between the coacting lugs L1, L2 can be adjusted by adjusting the chains of conveyor sections 151*b* so that the lugs L2 carried thereby move towards or away from the corresponding lugs L1 of conveyor section 151*a*. The drive sprockets, not shown, for conveyor sections 151*b* may be readily adjusted relative to its drive shaft, not shown.

A suitable operating control panel 191 is located on one side of frame 114, see FIG. 3, from which an operator can readily control the operation, including the speed, of the apparatus. Numerous shut-off switches 192, see FIGS. 3 and 5, are placed at various strategic locations about the apparatus.

The speed of operation of the apparatus in certain installations will depend upon the capacity of the filling line with which it is associated. It has been found that where the article carrier is of the type shown in FIG. 20, the apparatus 99 is capable of fully setting up collapsed carriers at a rate of at least 70 per minute if desired.

Thus, a high speed carrier setup apparatus and method have been disclosed which are fully automatic and capable of handling improved basket-type carriers of varying sizes and shapes.

We claim:

1. An apparatus for setting up a basket-type carrier from a blank of foldable sheet material partially folded to form a carrier in a collapsed state, the latter having a first plane defined by a slotted base panel, side panels foldably connected to first opposed peripheral segments of the base panel and coplanar therewith, and lower sections of end panels foldably connected to second opposed peripheral segments of the base panel and coplanar therewith, and a second plane defined by a pair of coplanar elongated handle unit panel sections having corresponding upper edge-forming peripheral segments connected to one another by a common foldline and corresponding end edge forming peripheral segments foldably connected to and coplanar with upper sections of the end panels, the upper and lower sections of each end panel being foldably connected together and said upper section overlying in face-to-face relation with the lower section in the collapsed carrier whereby the first and second planes are in proximate substantially parallel relation; said apparatus comprising first means for supporting and retaining the collapsed carrier at a substantially horizontal first station whereby the collapsed carrier second plane overlies the first plane thereof; second means disposed at said first station and including hinged means adapted to be positioned above said first means and the collapsed carrier supported thereby and being actuatable from an inoperative mode wherein said hinged means are in an elevated, substantially horizontal coplanar relation and in substantially parallel relation with the first station to an operative mode wherein said hinged means are in proximate substantially parallel upright relation and substantially perpendicular to said first station, said hinged means while moving from said inoperative mode to said operative mode being adapted to engage exposed surfaces of the panel sections when in coplanar relation, and simultaneously therewith move upwardly away from the horizontal first station causing the panel sections to fold relative to one another about the common foldline and be simultaneously pulled upwardly along with the upper sections of the end panels while the carrier base panel remains in a fixed substantially horizontal position at said first station thereby forming a partially set up carrier whereby the panel sections are in upright substantially face-to-face relation and the upper and lower sections of each end panel are simultaneously unfolded to partially upright positions, the partially upright end panels being in spaced relation and separated by the upright panel sections disposed therebetween and extending transversely thereof; and third means adjacent said first means and operable subsequent to the hinged means of said second means assuming a predetermined elevated substantially horizontal coplanar relation for moving the partially setup carrier through successive stations provided in said apparatus whereby the side panels are folded to upright substantially parallel relation and have peripheral portions thereof secured to corresponding fully upright end panels forming a setup carrier.

2. The apparatus of claim 1 wherein the second means includes a member disposed beneath the first means and mounted for movement relative thereto between extended and retracted positions; said member, when moving from said retracted position to said extended position, projecting through the slotted base panel of the collapsed carrier and supportingly engaging the underside of the common foldline connecting the handle unit panel sections, said extended member coacting with the hinged means, when the latter are moving to the operative mode, to effect controlled folding of the panel sections about the common foldline.

3. The apparatus of claim 1 wherein the hinged means of the second means are actuated about spaced substantially parallel horizontal axes, the spacing between said axes being adapted to accommodate therein the foldably connected upper edge-forming peripheral segments of the handle unit panel sections when the hinged means are actuated from the inoperative mode to the operative mode, said axes being disposed substantially parallel to the direction of movement of the partially setup carrier by said third means.

4. The apparatus of claim 2 wherein the first means includes holding means for operatively engaging predetermined portions of the collapsed carrier defining the first plane thereof and retaining the carrier base panel in a substantially fixed horizontal position at said first station as the hinged means are actuated from the inoperative mode to the operative mode and the member moves from a retracted position to the extended position.

5. The apparatus of claim 4 wherein the holding means includes suction members adapted to selectively engage predetermined areas of the exterior surface of the carrier base panel.

6. The apparatus of claim 5 wherein the hinged means of the second means is provided with suction members for selectively engaging predetermined exterior surface areas of a corresponding handle unit panel section during movement of said means from an inoperative mode to an operative mode.

7. The apparatus of claim 1 wherein the second means includes a substantially horizontally extending elongated member mounted for controlled vertical adjustment relative to the first means; the hinged elements of said second means being carried by and movable vertically with said elongated member but hingedly adjustable independently of said elongated member.

8. The apparatus of claim 1 wherein the third means moves the partially setup carrier to a second station in a forward direction whereby one end panel is leading and the other end panel is trailing; when at the second station, the end panels of the carrier are disposed between and engaged by lugs formed on two separate conveyor means movable in parallel forward directions; said separate conveyor means moving the carrier with the end panels thereof in parallel relation away from the second station while the carrier side panels remain in laterally extending, substantial coplanar relation with the base panel.

9. The apparatus of claim 8 wherein at least one of the separate conveyor means moves the carrier away from the second station to a third station wherein the leading edge portions of the laterally extending side panels are positioned for a predetermined time interval beneath laterally spaced adhesive applicators; as the carrier is moved from the second station to the third station, glue flaps foldably connected to the side edges of the leading upright end panel are folded rearwardly at substantially a right angle thereto; the third station includes actuatable folding means for folding forwardly at substantially a right angle glue flaps foldably connected to the side edges of the trailing upright end panel during said predetermined time interval; as the carrier is moved from the third station, subsequent to the expiration of the predetermined time interval, a given amount of adhesive is applied by the applicators to predetermined surface portions of the laterally extending side panels.

10. The apparatus of claim 9 wherein at least one of the separate conveyor means, after the predetermined time interval, moves the carrier away from the third station to a fourth station disposed downstream thereof whereby adhesive is first substantially instantaneously applied to the leading edge portions of the side panels and then as the trailing edge portions of the side panels slidably move beneath the adhesive applicators at said third station a given amount of adhesive is substantially instantaneously applied thereto; during movement of the carrier to the fourth station and after the carrier side panels have cleared the adhesive applicators, the carrier side panels are folded relative to the carrier base panel to substantially upright positions and the adhesively applied edge portions of the side panels are in substantial registration with the folded glue flaps.

11. The apparatus of claim 10 wherein the fourth station includes means operatively connected to said conveyor means for interrupting movement of the carrier at a predetermined location beneath a vertically adjustable backup means and between a pair of laterally adjustable presser means; when the carrier is disposed at said predetermined location, said backup means being movable downwardly into the carrier interior and having portions thereof disposed on opposite sides of the panel sections defining the handle unit and in substantially face-to-face relation with corresponding folded glue flaps of the carrier; subsequent to downward movement of said backup means, said presser means being movable towards one another into engagement with the exterior surface of the carrier upright side panels whereby the adhesively coated edge portions thereof and the corresponding folded glue flaps are pressed between the presser means and the backup means fixedly securing the side panels to the glue flaps; upon the backup means being movable upwardly out of the carrier interior and said presser means being movable laterally away from each other forward movement of the carrier away from the fourth station is resumed.

12. The apparatus of claim 11 wherein the carrier is moved away from the fourth station to a fifth station disposed downstream thereof and the forward movement of the carrier is interrupted upon the carrier reaching a predetermined location at said fifth station beneath a vertically movable handle unit holding means whereby the slotted base panel of the carrier is aligned with an enlarged opening formed in a substantially horizontal surface supporting and subtending the base panel, said holding means, when movable downwardly towards said surface and into an operative mode having portions thereof extending into the carrier interior on opposite sides of the folded panel sections defining the handle unit, said holding means portions slidably engaging the handle unit panel sections and retaining the latter in registered face-to-face relation whereby vertically extending slots formed in the lower edge portions of the panel sections are in vertical alignment with corresponding slots formed in the base panel; guide means substantially intermediate said fourth and fifth stations and in slidable engagement with the upright side panels of the carrier for restraining vertical and lateral relative movement of the carrier while moving towards and while disposed at the fifth station; and means disposed beneath the base panel supporting surface for inserting a substantially U-shaped insert piece up through the enlarged opening whereby upstanding legs of the insert piece extend through the base panel slots and interlockingly engage the vertically extending slots formed in the lower edge portions of the handle unit panel sections; the insert piece coacting with the handle unit panel sections to form the carrier interior into a plurality of compartments arranged in two parallel rows of three compartments each.

13. The apparatus of claim 12 wherein the means for inserting the insert piece into the carrier includes an insert piece forming assembly offset from the path of movement of the carrier from the fourth station to the fifth station; said assembly comprising a channel-shaped passage having an infeed segment and a longitudinally spaced discharge segment, the latter being disposed beneath the surface supporting the carrier at the fifth station and in alignment with the enlarged opening formed therein; a forming member movably mounted at the infeed segment of the passage for depositing into said passage a substantially U-shaped insert piece with the upstanding legs thereof in slidable engagement with opposed sides of the channel-shaped passage; and adjustable means for moving an insert piece along the passage from said infeed to said discharge segments, adjustment of the latter means being in timed sequence with the movement of said forming means.

14. The apparatus of claim 13 wherein movement of the insert piece is intermittent and the adjustable means for effecting such movement includes a reciprocating member which advances an insert piece along the passage only when said member is moving in one direction relative to the passage.

15. The apparatus of claim 14 wherein the reciprocating member includes extendable/retractable pawl means which extend only when said member is moving in said one direction relative to the passage and engage rear portions of the insert piece disposed within the passage.

* * * * *